US005958527A

United States Patent [19]

Prévost

[11] Patent Number: 5,958,527

[45] Date of Patent: Sep. 28, 1999

[54] PROCESS OF LAYING SYNTHETIC GRASS

[75] Inventor: Jean Prévost, Montreal, Canada

[73] Assignee: Fieldturf Holdings, Inc., Montreal, Canada

[21] Appl. No.: 09/177,266

[22] Filed: Oct. 22, 1998

[30] Foreign Application Priority Data

Sep. 21, 1998 [CA] Canada ..... 2247484

[51] Int. Cl.[6] ..... B32B 3/02

[52] U.S. Cl. ..... 428/17; 428/212

[58] Field of Search ..... 428/17, 212; 273/DIG. 13

[56] References Cited

U.S. PATENT DOCUMENTS

| | | |
|---|---|---|
| 3,740,303 | 6/1973 | Alderson et al. . |
| 3,995,079 | 11/1976 | Haas, Jr. . |
| 4,044,179 | 8/1977 | Haas, Jr. . |
| 4,337,283 | 6/1982 | Haas, Jr. . |
| 4,396,653 | 8/1983 | Tomarin . |
| 4,705,706 | 11/1987 | Avery . |

*Primary Examiner*—Alexander Thomas
*Attorney, Agent, or Firm*—Birch, Stewart, Kolasch & Birch, LLP.

[57] ABSTRACT

The invention relates to a synthetic grass turf assembly for installation on a supporting soil substrate to provide a game playing surface that combines the feel of natural turf with the wear resistance of synthetic turf. The turf assembly includes a pile fabric with a flexible sheet backing and rows of upstanding synthetic ribbons representing grass blades, extending upwardly from an upper surface of the backing. A unique infill layer of multiple distinct graded courses of particulate material is disposed interstitially between the upstanding ribbons upon the upper surface of the backing and of a depth less than the length of the ribbons. A base course is first placed upon the top surface of the backing and consists exclusively of hard sand granules. A middle course of intermixed hard sand and resilient rubber granules with relative weight ratio of 3 to 1 is then placed upon the base course. A top course exclusively of resilient rubber granules is then placed upon the middle course. The relatively thin top course that is in contact with users, has a high resilience where contact occurs and low abrasion due to exclusive use of rubber. The base sand course provides weight to hold the turf in place and to quickly drain the surface. The middle layer of mixed sand and rubber granules acts as a buffer to keep the base sand and top rubber courses separate avoiding migration of abrasive sand towards the top surface level. An upper portion of the synthetic ribbons extends upwardly from the top surface of the top course 0.25 to 1.00 inches to give the appearance of grass blades. Preferably the upper portion of the synthetic ribbons is fibrillated, split or frayed on site by passing over the installed surface with a stiff wire brush. The fibrillated surface has a slight resilience and visually appears like a natural grass turf. The criss-crossed fibrillated fibers contain the top course rubber granules while allowing dislodged rubber granules to fall back into place and permitting water to drain through to the sand containing courses.

11 Claims, 1 Drawing Sheet

PROCESS OF LAYING SYNTHETIC GRASS

TECHNICAL FIELD

The invention is directed to a synthetic grass turf with a unique multiple course resilient particulate infill that combines the look and feel of natural turf with the wear resistance of synthetic turf.

BACKGROUND OF THE ART

Natural grass turf has been traditionally cultivated on playing surfaces for sporting events and athletic games. Natural grass turf is generally preferred over hard surfaces, for example, since it provides some resilience and cushioning for foot impacts and games where players frequently fall on the playing surface, such as football and soccer. The natural grass stabilizes the underlying soil to minimize problems with mud and dust, and provides an attractive appearance.

Maintenance of natural grass turf on athletic playing areas is expensive, natural grass does not grow well within shaded enclosed stadiums and continuous heavy traffic wears out certain spots in the turf surface making it extremely difficult to prevent accumulation of water and mud.

Synthetic turf therefore has been developed in order to reduce the expenses of maintaining athletic playing areas, and to increase the durability of the turf surface, especially where professional sports are involved.

Synthetic turf generally involves a carpet-like pile fabric with a flexible backing laid on a compacted substrate, such as crushed stone or other stabilized base material. The pile fabric has rows of upstanding synthetic ribbons representing glass blades extending upwardly from the top surface of the backing. Of particular interest to the present invention are the various formulations for granular resilient fill that is placed between the upstanding ribbons on the upper surface of the backing to simulate the presence of soil. Most prior art systems involve some use of sand or crushed slag particles, together with a resilient foam backing or crumb rubber particles to provide resilience.

For example, U.S. Pat. No. 3,995,079 to Haas, Jr. discloses a use of a turf pile fabric for covering a golf green. The infill is a selection from granulated coal slag, crushed flint or crushed granite. A foam resilient underpad provides some resilience, however, the angular particles of the infill are relatively abrasive. Where abrasion is a problem such as games of football, rugby, soccer, field hockey, baseball and other games where players may fall down or be knocked down on the playing surface, there is a need to provide resilient materials which are not abrasive on the granular infill. For example, U.S. Pat. No. 4,337,283 to Haas, Jr. discloses mixing of fine hard sand particles with 25% to 95% by volume resilient particles to provide an improved resilient and non-abrasive soil imitating infill. Such resilient material may include mixtures of granulated rubber particles, cork polymer beads, foam rubber particles, vermiculite, and the like.

A number of disadvantages result from the use of a uniformly mixed granular infill as in prior art systems where hard sand particles and resilient rubber particles are mixed in a uniform manner throughout the depth of the infill. Synthetic grass turf infill, for example, may comprise a mixture of 60% by weight of sand and 40% granulated rubber particles uniformly mixed and deposited between the upstanding synthetic grass ribbons to a depth of 1 to 3 inches. A high percentage of sand is preferred to minimize the cost of such systems, since rubber particles are relatively expensive compared to sand. The sand particles also provide an improved degree of drainage that is needed where the synthetic grass surface is not in an enclosed stadium for example. Rubber particles tend to impede the free flow of water, whereas the capillary action of the sand particles draws surface moisture downwardly due to the differences in surface tension characteristics between rubber and silica sand.

Prior art infill systems fail to recognize that the infill is a dynamic system continuously in movement under the influence of bouncing balls, vibration and impact from the feet and bodies of players in contact with the top surface of the infill. For example, a uniformly mixed infill with high proportion of sand will result in spraying of sand particles when a ball or player impacts with the top surface of the infill. Over time, areas of continuous impact will separate and sand will be visible. It is considered undesirable to have light colored sand visible in the synthetic grass surface and, especially when clouds of sand are visible on such impacts. In addition, exposed sand granules are abrasive to the skin when players fall or slide on the top surface.

Particularly in the case of relatively thin layers of infill, the infill layers of sand and rubber tend to sort themselves and compact into relatively firm surfaces. Therefore, when initially installed, the uniformly mixed infill will provide an adequate degree of resilience, however, over time the resilience decays to the point where the surface is firm and compacted. To avoid this problem, it is possible to install a thicker layer of infill, however, the resulting surface can be too resilient and may result in injury to players. Quite often the main complaints of professional athletes are that cleats on shoes do not release consistently from tightly woven or knitted synthetic sport turf surfaces, causing knee and ankle injuries and the synthetic surface is hard and abrasive, causing skin bums and abrasions. Granular infill addresses these disadvantages by providing a synthetic surface that better imitates a natural soil and turf.

A further disadvantage of uniformly mixed infills is that abrasive sand particles remain on the top surface of the synthetic turf and players on the surface who come in contact with the sand particles experience skin abrasion. Over time, due to the dynamics of vibration and impact, the smaller sand particles will tend to settle toward the bottom of the infill layer and larger more abrasive sand particles will rise to the top surface. As a result, over time the abrasive nature of the synthetic system is increased and may result in particular areas of the playing surface which experience heavy traffic being more abrasive than other areas.

It is an object of the present invention to provide an infill that will retain its properties throughout use. It is a further object of the invention to reduce the abrasive nature of synthetic turf infills. A further object of the invention is to stabilize the top surface of the infill to retain a resilient grass like surface that does not deteriorate in quality or compact over time through use.

DISCLOSURE OF THE INVENTION

The invention provides a novel synthetic grass turf assembly for installation on a supporting soil substrate to provide a game playing surface that combines the look and feel of natural turf with the wear resistance of synthetic turf.

The turf assembly includes a pile fabric with a flexible sheet backing and rows of upstanding synthetic ribbons representing grass blades, extending upwardly from an upper surface of the backing. A unique infill layer of multiple distinct graded courses of particulate material is disposed interstitially between the upstanding ribbons upon the upper surface of the backing and at a depth less than the length of the ribbons.

The prior art utilises a uniformly mixed infill of sand and rubber particles. It has heretofore not been recognised that the infill acts as a dynamic system when exposed to impact and vibration of athletic play on the top surface. Sand particles migrate upward under impact as a ball or player hits the top surface of the infill. Dust and hard sand particles are abrasive to skin, and can spray into an athlete's eyes or ears. The appearance of bright coloured sand amongst green synthetic grass fibres is considered undesirable, whereas dark rubber particles are more suggestive of a natural soil surface.

Therefore, the presence of sand particles at the top surface of infill has significant disadvantages in exposing players to abrasion and spray of sand. However, use of rubber particles alone as infill is relatively expensive and may result in a highly resilient unnatural playing surface. Infill consisting of rubber particles only has poor capillary action drainage characteristics relative to sand. Sand has been traditionally mixed with rubber particles to provide drainage, reduce cost of infill, moderate resilience, and provide adequate weight to hold the fabric in place. Water percolating through the infill tends to move the sand particles downward, however due to mixing of sand and rubber throughout the infill layer, there remains a significant volume of sand close to the playing surface.

The invention recognises that the infill is a dynamic system of continuously moving particles under the influence of impact and vibration from play activity, surface maintenance and weather precipitation. The invention accommodates such dynamic activity in a number of ways. The top surface is kept substantially sand free by applying a pure rubber particle top course. Water percolation and drainage is accommodated with a pure sand base course. Dynamic interaction between the pure sand and pure rubber courses is buffered by a middle mixed course of selected proportions, such as for example: three parts sand to one part rubber by weight. The fibrillated top ends of the grass-like synthetic ribbons retain the relatively large top rubber particles in a loose net-like flexible structure. The loose criss-crossed net of fibrillated fibres also allows dislodged rubber particles to work back into the underlying top rubber course when foot traffic passes over the particles and synthetic ribbons. The combination of pure top rubber course and network of fibrillated ribbons gives the look and feel of a natural turf surface. The mixed sand and rubber middle course provides firm resilient support, and the high overall sand content provides weight and better drainage through the capillary action of the sand.

A base course is first placed upon the top surface of the backing and consists mainly of hard sand granules. Small quantities of rubber granules may be mixed with the sand without significantly effecting the functioning of the sand layer. The sand is washed to remove fines under 70 mesh to improve surface drainage. The maximum particle size may vary considerably depending on the application. For athletic playing fields the sand has particle size under 20 mesh to avoid abrasive contact with users of the playing surface. Preferably the size of sand particles used for athletic applications is between 30 and 50 U.S. screen mesh standard. For use in racehorse surfaces abrasion is not a problem and larger particle sizes under 14 mesh can be used.

A middle course of intermixed hard sand and resilient rubber granules with selected weight ratio of 3 to 1 for example, is then placed upon the base course. A top course exclusively of resilient rubber granules is finally placed upon the middle course. The rubber granules are of size between 10 and 30 mesh.

The relatively thin top course that is in contact with users, has a high resilience where contact occurs and low abrasion due to exclusive use of rubber. The base sand course provides weight to hold the turf in place and to quickly drain the surface. Better drainage is especially essential where there is a risk of freezing.

The middle layer of mixed sand and rubber granules acts as a buffer to keep the base sand and top rubber courses separate. The middle mixed layer prevents excessive migration of abrasive sand towards the top surface level. Light coloured sand at the top surface level is considered unsightly and on contact with a bouncing ball creates dust and risk of abrasive eye and body contact. The middle mixed sand and rubber layer keeps the sand from migrating upward appreciably into the top course, due to vibrations from surface play activity. Larger particles of relatively lightweight rubber will stay above smaller heavier sand particles. Since the sand particles are denser and smaller in size compared to the rubber particles, sand particles will fall downward within the voids between larger rubber particles under gravity and when carried by downwardly percolating water. The localised impact and vibration caused by surface activity, such as impact from bouncing balls and athlete's feet, will cause some of the sand particles to move upward within the middle mixed course and into the top course. However, the pure rubber top course will remain relatively free of sand particles, since downward washing of sand particles by water draining through the top surface will return the sand particles to the middle course. The relatively large voids between large rubber particles allows smaller sand particles to fall downwardly under gravity and vibration as well.

The combined multiple courses produce a resilient surface at lower cost and lesser thickness than methods. In contrast, uniformly mixed infill layers tend to consolidate into a firm compacted surface, and can be highly resilient and costly if applied in a thick layer. The invention maintains its resilience even when used in thin layers since the top layer is of pure rubber granules and the multiple courses do not tend to separate or compact.

Depending on the sport or other expected use of the surface, the upper portion of the synthetic ribbons may extend upwardly from the top surface of the top course from 0.25 to 1.00 inches to give the appearance of grass blades and control the rolling of balls during play. By also modifying the thickness and density of grass ribbon blades extending through the top surface, the rolling characteristics of a ball in play can be modified. Optionally, the upper portion of the synthetic ribbons is fibrillated, split or frayed on site by passing over the installed surface with a stiff wire brush or other brushing means. Optionally, ribbons may be fabricated of several fibre strands that fan out to produce a similar result, rather than a single ribbon strand that is fibrillated on site. Fibrillation and multiple fibres have several benefits as follows. The fibrillated surface has a slight resilience similar to real grass and visually appears more like a natural grass turf. The criss-crossed fibrillated fibres contain the top course rubber granules while allowing dislodged rubber granules to fall back into place and permitting water to drain through Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
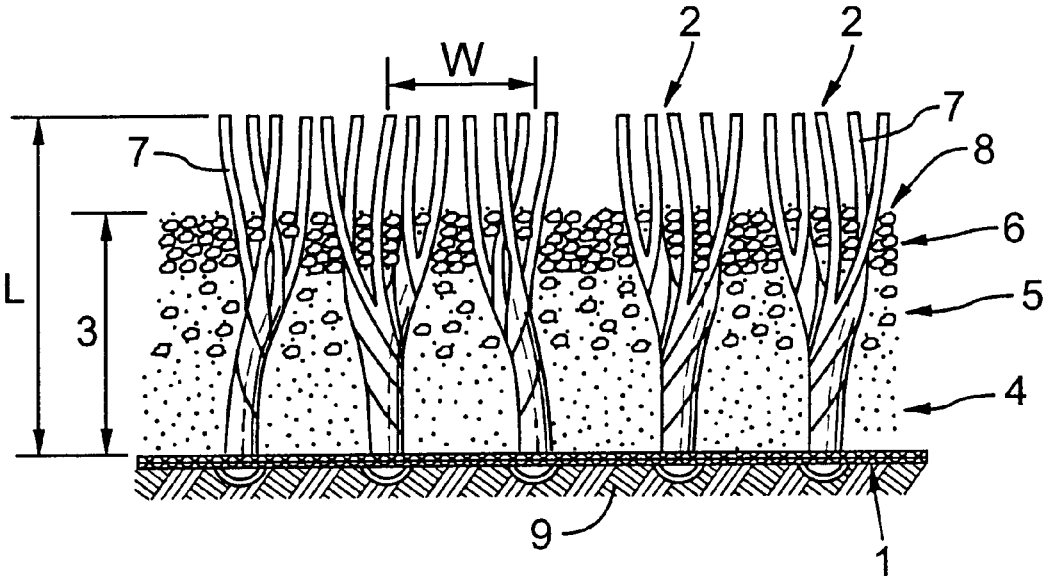
FIG. 1 is a cross-section through the installed synthetic grass turf assembly showing the flexible sheet backing with upstanding ribbons and the infill layer built up of multiple courses of hard sand and resilient rubber granules.

With reference to FIG. 1, the invention relates to a synthetic grass turf assembly consisting of a pile fabric with an infill layer of particulate matter which is installed on a supporting soil substrate to provide a game playing surface. The pile fabric includes a flexible sheet backing 1 that in the embodiment shown is a two-ply open weave fabric. Extending upwardly from an upper surface of the backing 1 is a large number of upstanding synthetic ribbons 2. As indicated in FIG. 1, the ribbons 2 are tufted through the backing 1 spaced apart in rows by a distance W and of a length L. The length is selected depending upon the depth of infill and the desired resilience of the completed synthetic grass turf assembly. Disposed interstitially between the upstanding ribbons 2 upon the upper surface of the backing 1 is an infill layer 3 of particulate matter. The particulate matter may be selected from any number of commonly available hard granules such as sand, small rocks or other graded particulate matter and resilient granules such as crumb rubber.

The infill layer 3 is made up of a base course 4, a middle course 5 and a top course 6. The base course 4 is substantially exclusively of hard sand granules disposed immediately upon the top surface of the backing 1. The middle course 5 is of intermixed hard sand granules and resilient rubber granules. The mix is selected on the basis of a weight ratio greater than 2 to 1 of hard and resilient granules respectively. The top course 6 is substantially exclusively of resilient rubber granules. An upper portion 7 of the synthetic ribbons 2 extends upwardly from a top surface 8 of the top course 6. The resulting artificial turf surface can be adapted for several indoor and outdoor uses, such as: athletic playing fields; horse racing, and recreational areas.

In order to deposit multiple distinct layers, it is necessary to pass over the same area several times with a substantially pure sand spreading operation then proceeding over the same area again with a mixed sand and rubber material. Thereafter, it is necessary to pass over the area again and distribute the substantially pure rubber material. Known methods may be used. For example, to deposit the sand layer a sand spreader may be used and thereafter the surface is brushed to raise the nap of the pile fabric and position the ribbons 2 in a generally upright position prior to depositing the second course 5. After spreading each course, it is necessary to brush the surface and raise the ribbons to an upstanding position as shown in the drawings.

The significant difference between the method of the invention and prior art is the depositing of multiple separate courses each with different characteristics. Of course, depositing multiple layers involves more skill and time than depositing a single thick layer, however, the advantages are significant and can be justified as explained above.

Figure 2:
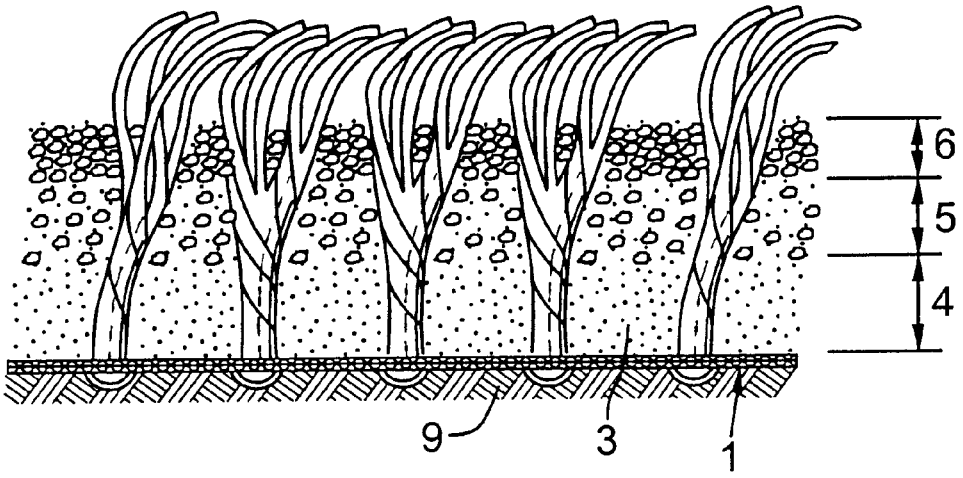
FIG. 2 is a like section showing the upper portions of the synthetic ribbons after they have been passed over with a stiff wire brush to fibrillate the top portions of the ribbons.

As shown in FIG. 2, it is preferred that after installation of the third top course 6, the upper portion 7 of the synthetic ribbons 2 is fibrillated by passing over the surface with a wire brush for example or other brushing means. This operation bends the upper portions 7 over the top surface 8 as shown in comparing FIG. 1 with FIG. 2. The ends of the ribbons 2 are split, frayed or fibrillated to achieve the following advantages over prior art methods. Laying over of the fibrillated upper portions 7, interweaves the ends into a loose network which more realistically simulates the appearance of natural grass. The fibrillated bent over ends impart a slight resilience since they are slightly raised or fluffed and more accurately simulate the resilience of natural grass when balls during play bounce on the completed surface. The bent over ends as well hide the rubber crumbs of the top course 6 from view, hold the crumbs in place and allow a movement of dislodged crumbs back and forth between the top course 6 and upper side of the fibrillated ribbons 2. By splitting or fibrillating the ends of the ribbons 2, water more easily permeates through the top surface 8 and is drained away by the base course 4.

It will be understood, although the embodiment described herein relates to use of hard sand granules and resilient rubber granules, that other suitable materials may also be used. All material must be graded by size and resiliency to ensure that the different layers remain substantially distinct and separated. For example, the hard granules can be synthetic plastic granules, crushed slag or any other hard granular material that will provide the needed drainage. Water percolating from the surface must quickly pass through the top course 6 and middle course 5 to the base course 4. The backing 1 may be an open weave fabric or be perforated to allow quick passage of water between the top surface 8 and the underlying substrate soil 9. As well, suitable resilient granules include rubber, vermiculite, cork, foam plastic, black or coloured EPDM rubber, and other relatively stable materials that will not decompose over time. Light coloured rubber granules of larger size will remain on the top of the infill layer and will reduce the heat retention of the infill.

The ribbons may include a mixture of multiple fibers and single ribbons fibrillated on site or left in their original state. Thin fibers cannot be top-dressed on site since they are more fragile and fall more easily than thicker fibers, especially in high heat environments. The mix of thick and thin fibers or the ribbons cause a ball to roll in a more predictable manner depending on the resistance of the fibers to the ball during play. Modification of the ribbon width and density in the turf will also modify the ball rolling characteristics.

It has been found through experiment and experience that the hard granules should be ideally of size ranging between 14 and 70 U.S. screen mesh standard. Hard granules larger than 20 screen mesh standard will be perceived as abrasive by users of the athletic surface and particles smaller than 70 screen mesh standard will tend to impede the percolation of water and detrimentally affect the drainage characteristics of the infill layer 3. Larger particles such as 14 screen mesh standard may be used where skin contact with the surface and abrasion is not expected. Preferably the sand is washed to remove substantially all the fine particles below size 70 mesh. The cost of purchasing such sand may be higher than non-washed sand, however, the improved drainage characteristics and the elimination of dust during dry periods is highly desirable. It is considered that the preferred size of sand particles range between 20 to 50 to avoid the risk of abrasion and provide superior drainage.

The mixed middle course has a specified weight ratio determined by the desired application. For example, in application to an athletic field, the preferred ratio is greater than 2 to 1 of sand to rubber granules and to reduce the cost the ratio can be increased to the order of 3 to 1. As a result, the costs of the middle layer is reduced since sand is generally much less expensive than rubber granules. Where higher or lower resilience is desired, the ratio can be modified as required.

The resilient granules are preferably crumb rubber particles cryogenically ground to a size ranging between 10 to 30 U.S. screen mesh standard. This choice of relative sizes of sand and rubber particles provides a gradual grading of materials between the pure sand base layer 4 and the pure rubber top course 6.

The sand particles will tend to remain in the lower areas even under impact and vibration since the sand particles are of smaller size and higher density. The larger and less dense rubber particles will migrate towards the top of the infill layer 3.

Therefore the invention recognizes that there will be a degree of movement in a dynamic system as the ribbons 2 and particles of the infill layer 3 are disturbed by foot traffic and impact inherent in the athletic games played on the surface. The substantially pure rubber top course 6 provides resilience where it is needed mainly, where the impact of athlete's feet and falling bodies will occur. If the top course 6 is too thick or lacks minimal sand mixed with the rubber granules however, poor drainage will result. Brushing periodically will remix sufficient sand with the rubber particles so that capillary action drainage can continue. The substantially pure sand base course 4 remains at the bottom of the infill layer due to its higher density and smaller size to provide the weight required to hold the pile fabric in position and to provide the necessary water drainage. The middle course 5 of mixed sand and rubber particles serve as a buffer zone to keep the pure top course 6 and pure sand base course 4 separated, and to add a controlled degree of resilience depending on the size and relative mixture of granular components.

As mentioned above, with respect to infills, there are significant disadvantages to allowing sand particles adjacent to the top surface 8. Sand is perceived as more abrasive to the skin than the rubber particles. Sand also is unsightly if it accumulates on the top surface 8 and creates dust or sprays of particles which are unsightly and may cause injury on contact with the eyes of athletes. Where the surface is exposed to precipitation, the percolation of water downward through the top course 6 will tend to carry with it sand particles thereby rinsing the top course 6 and repositioning the sand particles in the base course 4 and middle course 5.

As shown in FIG. 2, the fibrillation and bending over of the top portions 7 of the ribbons 2 will tend to hold or bind the rubber particles of the top course 6. As explained above therefore, the invention contemplates that there will be some movement of the particles and ribbons 2 as a result of traffic and movement of feet.

The natural tendency of the large relatively light rubber particles to migrate to the top and the complementary tendency of smaller heavier sand particulars to migrate to the bottom of the infill layer 3 is used to advantage. By providing a pure rubber resilient top course 6, resilience is provided where actually needed. Periodic brushing of the top layer 6 will mix sufficient sand into the top layer 6 to preserve the drainage characteristics. Additional resilience is provided when desired by varying the mixture or thickness of the layer. In contrast the prior art provides a uniform mixture throughout and the resilient particles positioned near the bottom of the layer provide less resilient activity at the top of the surface.

Sand particles in infill at the top surface result in significant disadvantage as explained above, including abrasion, dust and undesirable appearance. In contrast, the invention uses sand for the base course to provide drainage and weight. Resilience is provided where needed throughout when mixed evenly. More resilience is felt at the top surface when infilled in distinct layers. When the rubber is mixed evenly throughout, more quantity of rubber overall is required for the same thickness of infill to attain the same resilient feel at the top surface. Reduced rubber quantity reduces the cost. As well, the overall thickness of the infill layer 3 can be reduced. The cost of materials is significantly less than with systems while providing the same degree of resilience. For example, the top course 6 can be installed with a unit weight of 0.5 to 0.6 pounds or less per square foot of top surface area that has been found to be completely adequate for the purposes. The upper portion 7 of the synthetic ribbons 2 may extend upwardly anywhere between 0.25 to 1.0 inches from the top surface 8 of the top course 6. It has been found that this length of upper portion 6 provides a convincingly realistic grass like appearance at reasonable costs.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A synthetic grass turf assembly for installation on a supporting substrate to provide a game playing surface, the turf assembly comprising:

a pile fabric with a flexible sheet backing and a plurality of upstanding synthetic ribbons of a selected length, representing grass blades, extending upwardly from an upper surface of the backing; and an infill layer of particulate material disposed interstitially between the upstanding ribbons upon the upper surface of the backing and of a depth less than the length of the ribbons, the particulate material selected from the group consisting of: hard and resilient granules, the infill layer including:

a base course substantially exclusively of hard granules disposed upon the top surface of the backing;

a middle course of intermixed hard and resilient granules of a selected relative weight ratio, disposed upon the base course; and a top course substantially exclusively of resilient granules disposed upon the middle course, an upper portion of the synthetic ribbons extending upwardly from a top surface of the top course.

2. A synthetic grass turf assembly according to claim 1 wherein the relative weight ratio of hard to resilient granules is greater than 2 to 1.

3. A synthetic grass turf assembly according to claim 2 wherein the middle course weight ratio is in the order of 3 to 1.

4. A synthetic grass turf assembly according to claim 1 wherein the hard granules are sand particles of size ranging between 14 to 70 U.S. screen mesh standard.

5. A synthetic grass turf assembly according to claim 4 wherein the size of sand particles range between 20 to 50.

6. A synthetic grass turf assembly according to claim 5 wherein the sand has been washed to remove substantially all fine particles below size 70 mesh.

7. A synthetic grass turf assembly according to claim 1 wherein the resilient granules are crumb rubber particles of size ranging between 10 to 30 U.S. screen mesh standard.

8. A synthetic grass turf assembly according to claim 1 wherein the top course has an installed unit weight of up to 0.6 pounds per square foot of top surface area.

9. A synthetic grass turf assembly according to claim 1 wherein the upper portion of the synthetic ribbons is fibrillated on site.

10. A synthetic grass turf assembly according to claim 1 wherein the synthetic ribbons each comprise multiple fibres with a downwardly curved upper portion.

11. A synthetic grass turf assembly according to claim 1 wherein the upper portion of the synthetic ribbons extends upwardly 0.25 to 1.00 inches from the top surface of the top course.

* * * * *